United States Patent [19]

Kiyooka

[11] Patent Number: 4,817,230

[45] Date of Patent: Apr. 4, 1989

[54] DUST COLLECTOR

[75] Inventor: Katsumi Kiyooka, Saitama, Japan

[73] Assignee: Komatsu Zenoah Co., Japan

[21] Appl. No.: 117,417

[22] Filed: Nov. 2, 1987

Related U.S. Application Data

[63] Continuation of Ser. No. 753,923, Jul. 11, 1985, abandoned.

[30] Foreign Application Priority Data

Jul. 11, 1984 [JP] Japan ..... 59-142226

[51] Int. Cl.[4] ..... A47L 5/14; A47L 5/16; A47L 5/24

[52] U.S. Cl. ..... 15/330; 15/344; 15/409

[58] Field of Search ..... 15/330, 347, 409; 417/344, 151, 178, 87, 88, 76, 78

[56] References Cited

U.S. PATENT DOCUMENTS

| | | | |
|---|---|---|---|
| 1,078,512 | 11/1913 | Mills | 15/347 X |
| 1,723,828 | 8/1929 | von Sandt | 15/330 X |
| 3,808,631 | 5/1974 | Shibata et al. | 15/321 |
| 4,290,165 | 9/1981 | Hiramatsu et al. | 15/330 |
| 4,387,852 | 6/1983 | Mattson et al. | 239/143 |
| 4,403,371 | 9/1983 | Kiyooka | 15/328 |
| 4,554,701 | 11/1985 | Van Raaij | 15/347 X |

FOREIGN PATENT DOCUMENTS

| | | | |
|---|---|---|---|
| 0114114 | 7/1984 | European Pat. Off. | 15/330 |

*Primary Examiner*—Harvey C. Hornsby
*Assistant Examiner*—Scott J. Haugland
*Attorney, Agent, or Firm*—Wigman & Cohen

[57] ABSTRACT

A dust collector having a selector valve which enables a cleaning pipe to be connected with either a suction circuit communicating with a dust collecting portion, or a discharge circuit communicating with the discharge opening of a fan. By carrying out the shifting operation of said selector valve, the dust collector can be changed to suck and collect dust, or to blow and gather dust without rearranging the cleaning pipe.

7 Claims, 5 Drawing Sheets

DUST COLLECTOR

This is a continuation of application Ser. No. 753,923 filed on July 11, 1985 now abandoned.

BACKGROUND OF THE INVENTION

1. Field of the Invention

The present invention relates generally to a dust collector, and particularly to a dust collector having a dust collecting portion to collect dust sucked by a fan through a cleaning pipe.

2. Description of the Prior Art

There are several known dust collectors, one example of which is shown in FIG. 1. In the figure, a fan 1 has a discharge opening 3 which communicates with an air pipe 5. The air pipe 5 is connected with a cleaning pipe 9 through a confluence pipe 7. These elements are so constituted that a combined blast is sent to a dust collecting portion 11 comprising a dust collecting bag. A blast comes out of the fan 1 which is rotationally driven by an engine and flows into the dust collecting portion 11. In the confluence pipe 7, said blast draws air from the cleaning pipe 9 to generate suction air flow so that dust is sucked from the end of the cleaning pipe 9 and collected in the dust collecting portion 11.

FIG. 2 shows a second embodiment of a conventional dust collector. In the figure, dust is sucked by a fan 1 from the end of a cleaning pipe 9. The dust is sucked through a suction opening 13 of the fan 1, discharged from a discharge opening 3, and collected in a dust collecting portion (dust collecting bag) 11. After that, air is released into atmosphere through fabric.

FIG. 3 shows a third embodiment of a conventional dust collector. In the figure, dust sucked from the end of a cleaning pipe 9 is collected by a wire mesh 15. After that, air is sucked through a suction opening 13 of a fan 1 and released into atmosphere through a discharge opening 3.

In such conventional dust collectors, there is the disadvantage that the cleaning pipe 9 shall be rearranged when it is required to blow air from the cleaning pipe 9, instead of drawing air with dust from the cleaning pipe 9, to blow and gather dust such as fallen leaves on the ground. In the embodiment shown in FIG. 1, the confluence pipe 7 shall be removed, and the cleaning pipe 9 shall directly be connected to the discharge opening 3 or to the air pipe 5 to blow air from the cleaning pipe 9. In the embodiment shown in FIG. 2, the dust collecting portion 11 shall be removed from the fan 1, and the cleaning pipe 9 shall be connected to the discharge opening 3 of the fan 1 as shown in FIG. 3 to blow air from the cleaning pipe 9.

SUMMARY OF THE INVENTION

An object of the present invention is to provide a dust collector which is capable of changing blow direction inside a cleaning pipe of the dust collector.

Another object of the present invention is to provide a dust collector having a selector valve with which the connection of a cleaning pipe of the dust collector can selectively be changed without removing and reassembling the cleaning pipe so that the dust collector can either suck dust, or blow and gather dust.

In order to accomplish the objects and advantages mentioned in the above, there is provided according to the present invention a dust collector having a selector valve which enables a cleaning pipe to be connected with either a suction circuit communicating with a dust collecting portion, or a discharge circuit communicating with the discharge opening of a fan. By carrying out the shifting operation of said selector valve, the dust collector can be changed to suck and collect dust, or to blow and gather dust without rearranging the cleaning pipe.

DETAILED DESCRIPTION OF THE EMBODIMENTS

Figure 1:
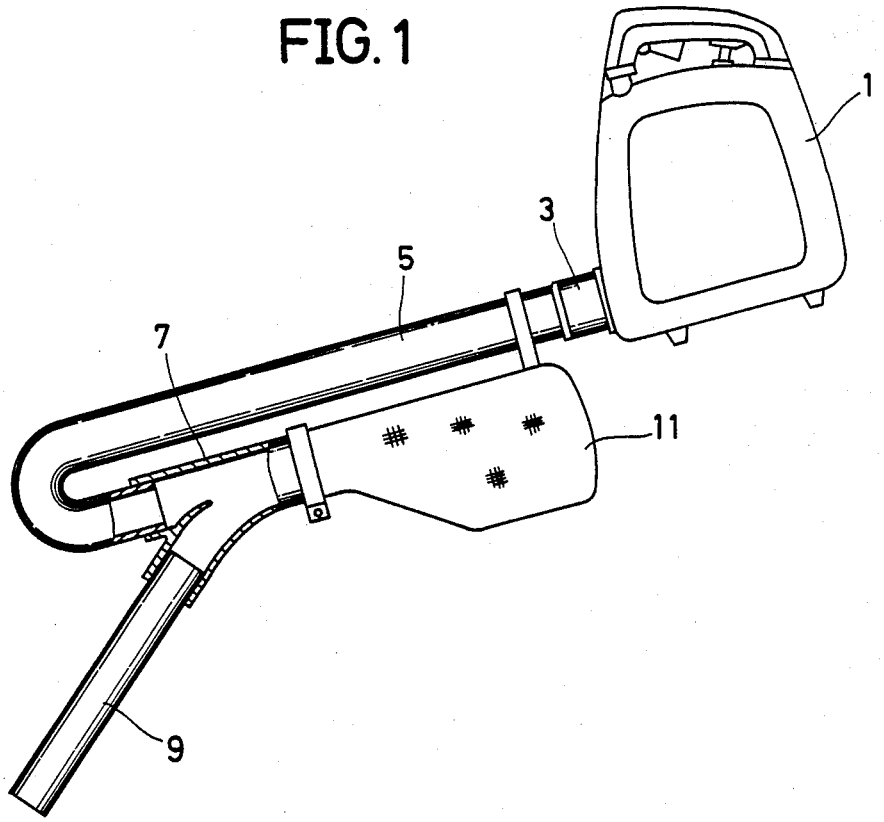
FIG. 1 is a cross sectional side view of the first embodiment according to the prior art.
Figure 2:
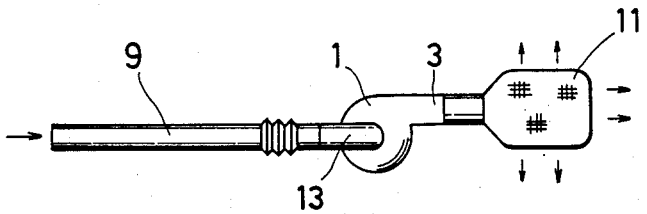
FIG. 2 PRIOR ART
FIG. 2 explains the air routing of the second embodiment according to the prior art.
Figure 3:
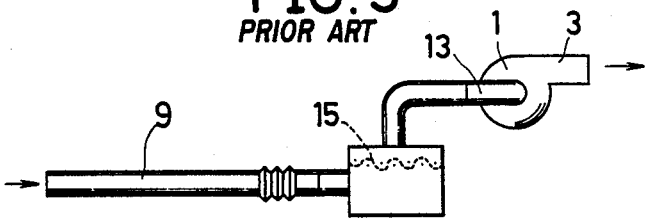
FIG. 3 PRIOR ART
FIG. 3 explains the air routing of the third embodiment according to the prior art.
Figure 4:
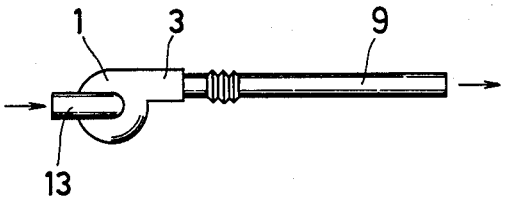
FIG. 4 PRIOR ART
FIG. 4 explains the air routing of the fourth embodiment according to the prior art.
Figure 5:
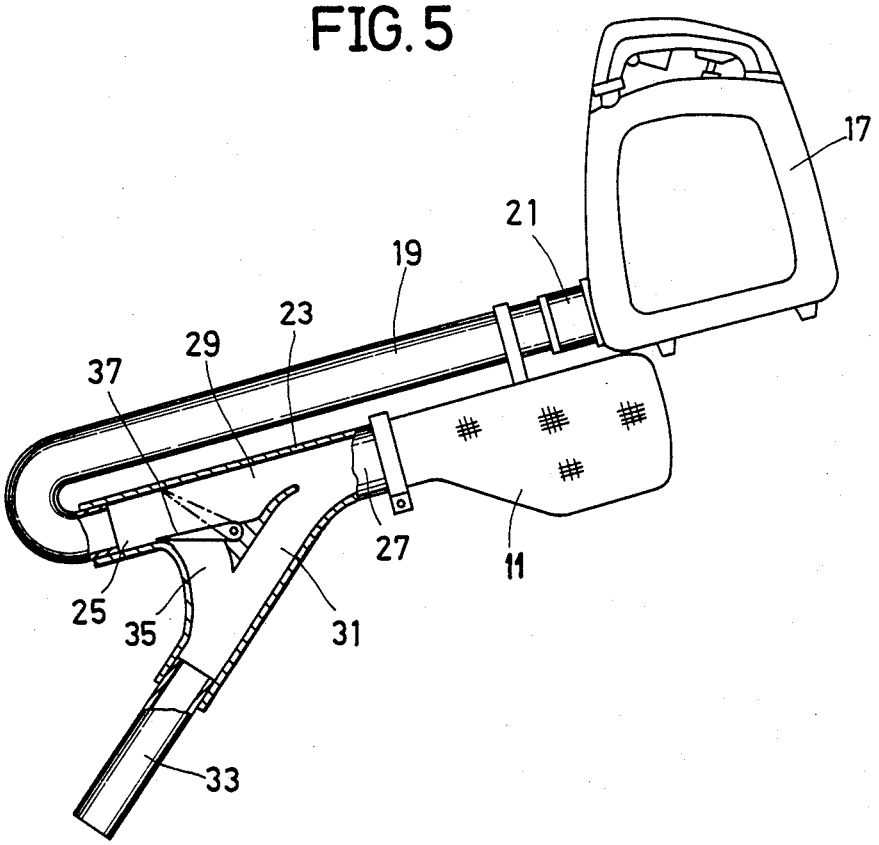
FIG. 5 is a cross sectional side view showing the first embodiment of the present invention.

In FIG. 5, the numeral 17 represents a portable fan accommodating an engine (not shown) and a blower fan (not shown). The numeral 19 represents an air pipe connected to a discharge opening 21 of the fan 17. The numeral 23 represents a confluence pipe connected to the air pipe 19, wherein a dust suction path 31 which is obliquely combined with an air path 29 provided between an inflow mouth 25 and an outflow mouth 27 is combined toward the outflow mouth 27. The numeral 33 represents a cleaning pipe connected to the lower end of the dust suction path 31, the numeral 35 a branch path for communicating the air path 29 and the dust suction path 31 with each other, and the numeral 37 a selector valve provided at a junction between the air path 29 and the branch path 35, said selector valve 37 being operated by an externally provided handle (not shown) to select the air path 29 or the branch path 35 to send blast flown from the air pipe 19. As depicted in FIG. 5, the numeral 11 represents a bag like dust collecting portion connected to the outflow mouth 27. In this embodiment, blast sent out of the fan 17 flows into the dust collecting portion 11 through the air pipe 19 and the air path 29. Due to said blast flow, air in the dust suction path 31 is drawn to suck dust from the end of the cleaning pipe 33 and collects said dust in the dust collecting portion 11. If the selector valve 37 is switched to close the air path 29 and open the branch path 35 as shown by an imaginary line in FIG. 5, blast is discharged out of the cleaning pipe 33 through the branch path 35 so that dust on the ground can be blown and gathered.

Figure 6:
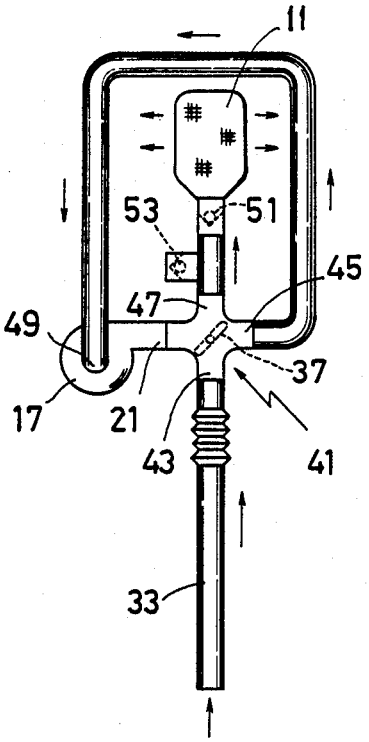
FIG. 6 explains the air routing of a second embodiment of the present invention.
Figure 7:
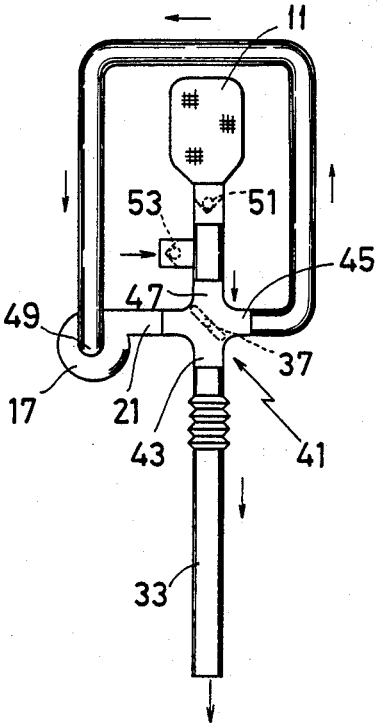
FIG. 7 explains the air routing according to another shifting position of the second embodiment of the present invention.

FIGS. 6 and 7 show the second embodiment according to the present invention, in which a four-way branch tube 41 is connected to the discharge opening 21 of the fan 17. The selector valve 37 is provided inside the four-way branch tube 41. Branch openings 43, 45, and 47 of the four-way branch tube 41 communicate with the cleaning pipe 33, the suction opening 49 of the fan 17, and the dust collecting portion 11 respectively. The numeral 51 represents a check valve which provides communication from the branch opening 47 toward the dust collecting portion 11, the numeral 53 a check valve which provides communication from the atmosphere toward the branch opening 47. If the selector valve 37 is shifted to a position shown in FIG. 6, the sucking blast of the fan 17 draws dust from the end of the cleaning pipe 33, said blast with dust passing through the branch openings 43 and 45, the suction opening 49 of the fan 17, the discharge opening 21, the branch opening 47, and the check valve 51 to collect dust in the dust collecting portion 11. If the selector valve 37 is switched to a position shown in FIG. 7, atmosphere is drawn through the check valve 53, and branch openings 47 and 45 into the suction opening 49 of the fan 17, and then discharged from the cleaning pipe 33 through the discharge opening 21 to blow and gather dust on the ground.

Figure 10:
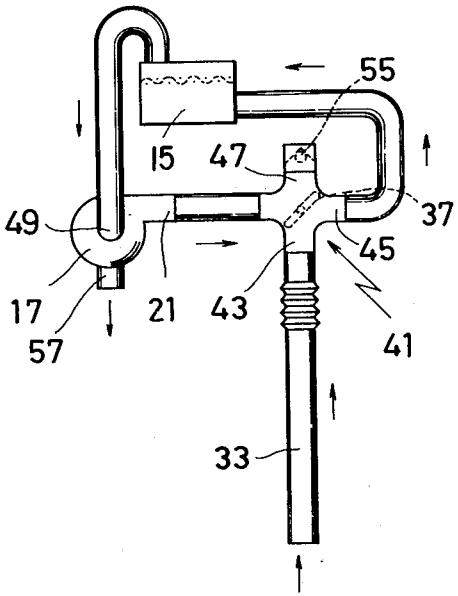
FIG. 10 explains the air routing of the fourth embodiment of the present invention.
Figure 9:
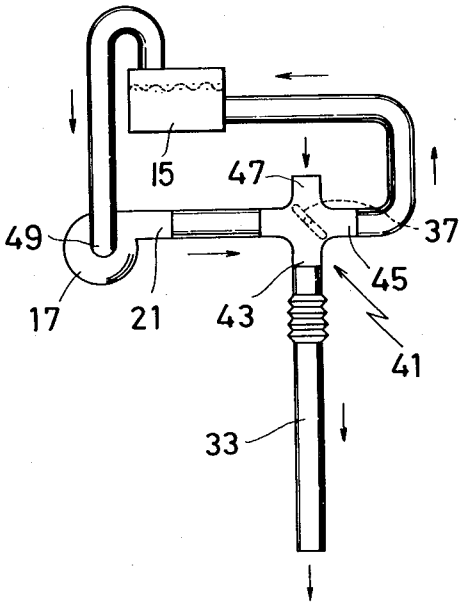
FIG. 9 explains the air routing according to another shifting position of the third embodiment of the present invention.
Figure 8:
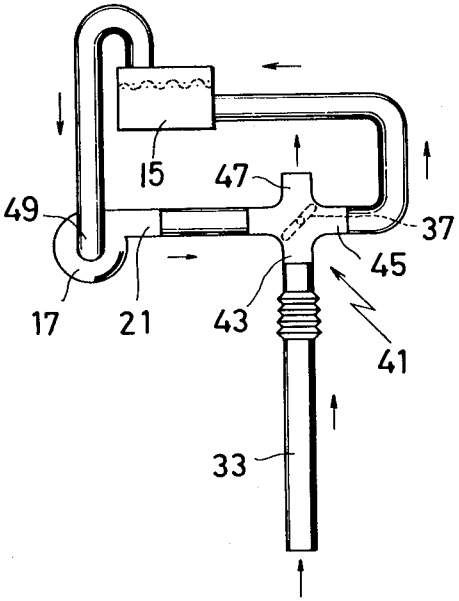
FIG. 8 explains the air routing of the third embodiment of the present invention.

FIGS. 8 and 9 show the third embodiment according to the present invention. The branch openings 43, 45, and 47 of the four-way branch tube 41 connected to the discharge opening 21 communicate with the cleaning pipe 33, the suction opening 49, and atmosphere respectively. The dust collecting portion 15 is provided between the branch opening 45 and the suction opening 49. If the selector valve 37 is switched to a position shown in Fig. 8, atmosphere with dust is drawn from the end of the cleaning pipe 33, passed through branch openings 43 and 45, and the dust collecting portion 15 to collect dust. Sucked air is released from the branch opening 47 into atmosphere through the suction opening 49 and the discharge opening 21. If the selector valve 37 is switched to a position shown in FIG. 9, atmosphere is sucked into the suction opening 49 through the branch openings 47 and 45, and the dust collecting portion 15, and blown from the cleaning pipe 33 through the branch opening 43 to blow and gather dust on the ground. Fig. 10 shows the fourth embodiment according to the present invention, in which a check valve 55 which permits air flowing only from atmosphere is provided for the branch opening 47 of the third embodiment shown in FIGS. 8 and 9. In this embodiment, blast after dust being collected is not released from the branch opening 47 into atmosphere, but utilized as cooling air of the engine and released from a separate cooling air opening 57.

According to the constitution of the present invention stipulated in the claims, the dust collecting work and the dust blasting and gathering works can be easily switched from one to another without rearranging the cleaning pipe, thereby improving the efficiency of the cleaning work.

It shall be understood that the present invention is not limited by the embodiments described herein and that modifications may be made without departing from the scope of the present invention.

I claim:

1. A dust collecting device comprising:

a fan for generating air currents;

a U-shaped air pipe having first and second ends, the first end of the U-shaped air pipe being connected to the fan;

a dust collecting means for collecting dust;

a cleaning pipe through which the air currents flow;

a confluence pipe with a confluence region located therein, the confluence pipe having three ports, with the first of the ports connected to the second end of the air pipe, and said first port having an under side and an upper side, the second of the ports connected to the dust collecting means, the third of the ports connected to the cleaning pipe, and the confluence pipe being formed such that the ports connected to the air pipe and the dust collecting means are substantially aligned, such that the ports connected to the air pipe and the cleaning pipe are at an acute angle with respect to each other; and selector valve means including a stationary portion disposed within the confluence region, the stationary portion defining inside the confluence pipe an air pass path for the passage of air from the air pipe to the dust collecting means, a branch path for the passage of air from the air pipe to the cleaning pipe, and a suction path for the passage of air from the cleaning pipe to the dust collecting means, and further including a movable valve member having a substantially plate-like shape with first and second ends, the first end of the movable valve member being pivotally connected to the stationary portion, wherein the movable valve member is pivotally shifted from outside the confluence pipe between first and second positions in which the second end of the movable valve member is abutted on said under or said upper side of the first port, respectively, such that at the first position the movable valve member blocks the branch path so that the air pipe communicates with the dust collecting means through the air pass path, whereby a suction is created that allows the cleaning pipe to suck dust and other debris from the outside into the cleaning pipe and through the suction path into the dust collecting means, and at the second position the movable valve member blocks the air pass path with the movable valve member being kept in position by the air flow from the air pipe so that the air pipe communicates with the cleaning pipe through the branch path, whereby air is caused to flow to the outside through the cleaning pipe to blow dust and other debris.

2. A dust collecting device of claim 1 wherein said fan is a portable fan comprising an engine and a blower fan.

3. A dust collecting device of claim 1 wherein said dust collecting means is made of fabric.

4. A dust collecting device as set forth in claim 1, wherein said selector valve means is formed such that a flow from the cleaning pipe flows smoothly into the dust collecting means when the dust collecting device sucks dust through the cleaning pipe, and a flow from the air pipe flows smoothly into the cleaning pipe through said branch path when the dust collecting device blows dust.

5. A dust collecting device as set forth in claim 1, wherein said collecting means is disposed near the fan.

6. The dust collecting device of claim 1, wherein the line of sight from the first end of the movable valve member to the second end of the movable valve member is in a direction substantially opposite that of the direction of the flow of air flowing into the confluence pipe form the air pipe.

7. The dust collecting device of claim 1, wherein the selector valve means is formed so as to provide a U-shaped surface area that faces the first port of the confluence pipe when the movable valve member of the selector valve is set in the second position.

* * * * *